United States Patent [19]

Brodalla et al.

[11] Patent Number: 4,939,001

[45] Date of Patent: Jul. 3, 1990

[54] PROCESS FOR SEALING ANODIZED ALUMINUM

[75] Inventors: Dieter Brodalla; Winfried Kirchhoff, both of Duesseldorf; Willi Wuest, Ratingen; Helmut Blum; Wolfgang Riedel, both of Duesseldorf, all of Fed. Rep. of Germany

[73] Assignee: Henkel Kommanditgesellschaft auf Aktien, Duesseldorf, Fed. Rep. of Germany

[21] Appl. No.: 365,869

[22] Filed: Jun. 14, 1989

[30] Foreign Application Priority Data

Jun. 18, 1988 [DE] Fed. Rep. of Germany ..... 3820650

[51] Int. Cl.[5] ..... B05D 1/18

[52] U.S. Cl. ..... 427/419.2; 204/38.3; 427/419.8

[58] Field of Search ..... 427/419.2, 419.7, 419.8; 204/38.3

[56] References Cited

U.S. PATENT DOCUMENTS

| | | | |
|---|---|---|---|
| 3,900,370 | 8/1975 | Germscheid et al. | 204/38.1 |
| 3,961,111 | 6/1976 | Smith | 427/419.2 |
| 4,045,599 | 8/1977 | Remaley et al. | 427/419.2 |
| 4,121,980 | 10/1978 | Gohansen et al. | 204/37.6 |
| 4,351,796 | 9/1982 | Marshall | 422/15 |
| 4,383,897 | 5/1983 | Gillich et al. | 204/38.3 |
| 4,399,021 | 8/1983 | Gillich et al. | 204/38.3 |
| 4,448,647 | 5/1984 | Gillich et al. | 204/38.3 |
| 4,452,674 | 6/1984 | Gillich et al. | 204/38.3 |
| 4,756,772 | 7/1988 | Gazapo et al. | 427/419.2 |

FOREIGN PATENT DOCUMENTS

| | | | |
|---|---|---|---|
| 2211553 | 9/1973 | Fed. Rep. of Germany | 204/38.1 |
| 2650989 | 5/1978 | Fed. Rep. of Germany | 204/37.6 |

*Primary Examiner*—Sadie Childs

*Attorney, Agent, or Firm*—Ernest G. Szoke; Wayne C. Jaeschke; Norvell E. Wisdom, Jr.

[57] ABSTRACT

In the process of sealing decorative anodized aluminum oxide coatings in hot aqueous solutions, superior results are obtained when the sealing solutions contain 1-phosphonopropane-1,2,3-tricarboxylic acid, 1,1-diphosphonopropane-2,3-dicarboxylic acid, and/or alkali metal and/or alkanolamine salts of these acids. The presence of these acids or their salts prevents the formation of bloom and allows shorter sealing times with equivalent quality, and the addition of as little as 1 ppm of aluminum ions to such solutions also prevents iridescence.

20 Claims, No Drawings

PROCESS FOR SEALING ANODIZED ALUMINUM

FIELD OF THE INVENTION

The invention relates to an improved process for achieving the so-called "sealing" of decorative anodized oxide layers on aluminum and aluminum alloys, both of which are referred to hereinafter simply as aluminum, except where the context clearly requires otherwise. Anodized layers as initially formed are porous, with the pores extending to the exterior surface. The properties of such layers, particularly the decorative properties such as color, are consequently more susceptible than is desirable to change under the influence of environments to which they may be exposed. The sealing process greatly reduces the porosity of at least the outer part of an anodized layer, thus making it more resistant to corrosion and other changes under the influence of its environment.

STATEMENT OF RELATED ART

Anodically produced oxide layers are frequently applied as decorative layers and protective layers on aluminum, particularly for architectural use. Such oxide layers protect against deterioration under the influences of weather and other corrosion favoring exposures. Furthermore, the anodized oxide layers are applied also in order to obtain a harder surface and, thereby, to obtain a higher wear resistance of the aluminum. Particularly decorative effects may be achieved by anodization, because the anodized layers have a natural color, which can be varied by varying the conditions of anodization, and the layers can be dyed to give many other colors.

A number of processes are known for applying decorative anodized oxide layers onto surfaces made of aluminum. For example, the production of the oxide layer may be effected with direct current in sulfuric acid solutions, in solutions of organic acids such as sulfophthalic acid or sulfanilic acid, or in mixtures thereof with sulfuric acid. The layers thus formed are not durable, because they have a very porous structure. For this reason, before normal use of aluminum with an anodized layer, it is necessary to close the outer pores of the layer. This "sealing" is often effected by contact with hot or boiling water.

In sealing of anodically applied oxide layers by simple exposure to hot water, the surface pores are closed, while simultaneously the structure of the oxide layer is changed. In addition, a more or less velvety textured layer of hydrated aluminum oxide, called "bloom" or "sealing smut" in the art, is usually formed over the entire surface. This bloom can greatly impair the decorative appeal of anodized aluminum, because it is very easily blemished by even light abrasion or touching, especially by human hands with natural oils readily transferable to the bloom or smut layer. Furthermore, the bloom layer reduces the adhesion strength when trying to bond such aluminum parts and, due to its large effective surface area, promotes later contamination and corrosion.

German Published Unexamined Patent Application (DE-OS) 22 11 553 describes a process for treating the surfaces of aluminum or aluminum alloys by anodic generation of oxide layers, with a subsequent sealing in aqueous solutions at elevated temperatures. In this process, by adding definite phosphonic acids in combination with further additions of calcium ions, formation of bloom is largely prevented and troubles caused by hardening salts in water are avoided. The sealing is carried out at temperatures of between 90° C. and the boiling temperature and at a pH value of from 5.5 to 6.5. In this process there may be used phosphonic acids, or the water-soluble salts thereof, which form complexes with divalent metals, for example 1-hydroxyethane-1,1-diphosphonic acid, 1-hydroxyhexane-1,1-diphosphonic acid, 1-hydroxypropane-1,1-diphosphonic acid, 1-aminoethane-1,1-diphosphonic acid, dimethylaminomethane-1,1-diphosphonic acid, ethylenediaminetetramethylenephosphonic acid, aminotrimethylenephosphonic acid, 2-phosphonobutane-1,2,4-tricarboxylic acid or 1-phosphono-1-methylsuccinic acid. However, on dark colored surfaces, an optimum surface finish satisfying decorative demands cannot always be obtained by this process.

European Published Unexamined Patent Application (EP-OS) No. 122 129 describes a process for sealing anodized aluminum surfaces with aqueous solutions having a pH value of at least 7 in the presence of agents preventing the formation of bloom. The sealing bloom preventing agents used include: Dextrins, acrylic acid, methacrylic acid, water-soluble polymers of acrylic acid or methacrylic acid-lignin sulfonates, cycloaliphatic or aromatic polycarboxylic acids and cyclohexane-hexacarboxylic acid, water-soluble phosphonic acids forming complexes with divalent metals, reaction products of sulfonated aromatic compounds with an aldehyde and/or dimethylol urea, or a mixture comprising formaldehyde and urea. Particularly preferred among these are: Phosphonic acids, preferably ethylenediamino-tetra(methylenephosphonic acid), hexamethylenediamine-tetra(methylenephosphonic acid), n-propyliminobis(methylenephosphonic acid), benzenehexacarboxylic acid and its salts, and the reaction products of sulfonated aromatic compounds with an aldehyde and/or dimethylol urea or a mixture comprising formaldehyde and urea. However, no information is given in the Examples on the conditions of anodization. Moreover, the classification set forth there of the surface layers into "Heavy Bloom" or "No Bloom" is not sufficiently definite to be equivalent to finish evaluation by a panel of experts in the important field of decorative architecture.

Accordingly, it is an object of the present invention to provide an improved process for sealing decorative anodized oxide layers on surfaces of aluminum and aluminum alloys.

DESCRIPTION OF THE INVENTION

In this description, except in the operating examples or where otherwise expressly indicated to the contrary, all numbers specifying amounts of materials or conditions of reaction or processing are to be understood as modified in all instances by the term "about".

The above object is attained by a process for sealing decorative anodized oxide layers on surfaces of aluminum and aluminum alloys by contact with an aqueous solution containing phosphonic acids or the alkali metal and/or alkanolamine salts thereof and having a pH value within the range of from 5.5 to 8.5, at temperatures between 80° C. and the boiling temperature of the aqueous solution, said process being characterized in that the phosphonic acids are selected from 1-phosphonopropane-1,2,3-tricarboxylic acid and/or 1,1-diphosphonopropane-2,3-dicarboxylic acid.

An advantage of the use according to the invention of 1-phosphonopropane-1,2,3-tricarboxylic acid, hereinafter designated as "PPT", and/or 1,1-diphosphonopropane-2,3-dicarboxylic acid, hereinafter designated as "DPD", is that surfaces prepared according to the invention are significantly improved in their visual surface appearance and in behavior upon outdoor weathering, compared with decorative surfaces of aluminum and aluminum alloys prepared with other phosphonic acids according to prior art. Also at elevated pH values above pH 7, decorative surfaces which do not exhibit iridescence can be prepared. Therefore, in comparison to decorative surfaces prepared according to prior art, either better results are obtained according to the conventional quality tests, or the same quality is achieved within shorter periods of sealing time.

In the place of the above-mentioned phosphonic acids, their water-soluble salts, preferably the sodium, potassium, ammonium, and/or alkanolamine salts, can be employed.

In preparing the solutions according to this invention, most normal tap water can be used, without needing deionization or softening. If fully deionized or distilled water or a very soft water is used for the preparation of the solutions, it is not necessary, in contrast to all prior art known to the applicants, to add any calcium ions.

According to the invention, the process for sealing anodically produced oxide layers on aluminum and aluminum alloys in aqueous solutions containing phosphonic acids or salts thereof may be carried out at a pH value of from 5.5 to 8.5 at a temperature between 80° C. and the boiling temperature. For the adjustment of the pH value there may be used—depending on the desired pH value—acids and/or bases as known to one skilled in the art. Preferred acids and bases are acetic acid, sulfuric acid, ammonia, potassium hydroxide, and triethanolamine. A technical triethanolamine which usually contains minor amounts of diethanolamine and monoethanolamine may also be used. The addition of a strong acid is usually not needed, because sulfuric acid or acidic sulfates entrained during the preceding anodization process are usually carried into the sealing solution. Stabilization of the desired pH value is normally effected by adding to the solutions a buffering agent, such as a salt of a weak base and a strong acid, or a salt of a strong base and a weak acid.

According to one preferred embodiment of the present invention, solutions are employed which have a pH value within the range of from 5.5 to 6.5. To adjust the pH value within this range, acetic acid and ammonia and/or acetic acid and potassium hydroxide are added to the solutions as needed. The buffering salts formed by the addition of these reagents, ammonium acetate and/or potassium acetate may also be added to the solutions.

According to another preferred embodiment of the present invention, solutions are employed which have a pH value within the range of from >6.5 to 8.5, and more specifically within the range of from 7.0 to 7.5. To adjust the pH value within this range, acetic acid and potassium hydroxide and/or acetic acid and triethanolamine may be added to the solutions. Here also, the corresponding buffering salts, potassium acetate and/or triethanolammonium acetate may be alternatively or additionally used in the solutions.

The operation of the process in accordance with the above-mentioned preferred embodiments of the invention results in a particularly good finish of the treated surfaces.

Solutions employed according to the invention preferably contain PPT and/or DPD in a certain minimum amount in order to produce anodically generated oxide layers which exhibit greater advantages over prior art. Also an upper limit on the concentration of phosphonic acid is preferred, because otherwise a deterioration of the surface quality will occur. Specifically, it is strongly preferred that the process according to the present invention, for sealing anodically generated oxide layers on aluminum and aluminum alloys is characterized in that the solutions contain from 0.003 to 0.1 g/l of PPT and/or DPD, or the stoichiometric equivalent of this amount of acid in the form of salts of the acid(s).

According to a still more preferred embodiment of the present invention, the process is carried out with solutions which contain from 0.005 to 0.025 gl of PPT and/or DPD and/or salts in stoichiometric equivalence to these amounts of acids.

By means of the inventive process it is now possible to prevent bloom from being formed while accomplishing sealing in an improved manner without impairing the decorative value of an anodically produced oxide layer. Troubles caused by hardness-forming materials in water do not occur, so that, advantageously, untreated tap water can be used. Precipitates formed by hardness materials in water are usually not observed. In water of very high hardness, flaky, heavy precipitates may be formed, but these are not observed to deposit on the sealed articles, but instead collect on the bottom of the container in which sealing is performed and may be readily separated from the sealing baths.

According to another preferred embodiment of the process according to the invention, at the beginning of the sealing at least about 1 ppm of aluminum ions in the form of a water-soluble aluminum compound is added to the solutions. The water-soluble aluminum compounds preferably are aluminum salts with anions known to be compatible with the sealing solutions, for example aluminum sulfate or aluminum acetate. The amount of aluminum ions used is preferably from 1 to 20 ppm, and more particularly 1 ppm. This addition significantly reduces the likelihood of development of iridescence on the anodized surfaces after sealing according to the invention.

The process according to the invention provides a distinct improvement in the appearance of the treated surface, and no run-off traces remain visible.

The practice of the invention may be further appreciated from the following, non-limiting, operating examples.

EXAMPLES

In the following Examples, Type 6063 aluminum alloy containing magnesium and silicon was used. Test specimens of this alloy were degreased in an aqueous solution consisting of 5% of P3-Almeco® 18 (alkaline cleansing agent containing borates, carbonates, phosphate and nonionic surfactants) at a temperature of 70° C. Then they were etched at 65° C. for about 15 minutes in a solution containing 112 g/l of dissolved aluminum, 80 gl of NaOH, and P3-Almeco® 46 (a commercial composition containing alkali, alcohols and salts of inorganic acids). P3-Almeco® 46 was used in a ratio of 1:6 relative to NaOH.

This etching was followed by pickling at room temperature for 5 minutes, using an aqueous solution containing 5% of P3-Almeco ® 90 (a commercial pickling agent containing inorganic acids and salts of inorganic acids).

After each of these chemical treatments, the specimens were thoroughly rinsed with de-ionized water.

Subsequent anodization of the specimens was carried out under the following conditions: Bath composition, 200 g/l of sulfuric acid and 10 gl of aluminum in water; air purging at a rate of 8 volumes of air per volume of bath per hour; temperature, 20° C.; direct current at a voltage of 15 V. The duration of the anodization was about 3 min/μm of layer build-up, so that the total anodization times for the oxide layer of about 20 μm as set forth in the following Examples were about 45 to 55 minutes.

The specimens which were to be subjected to a visual acceptance test of the surface finish subsequently were dyed black. This was done in an electrolyte containing 18 g/l of tin(II) sulfate, 25 g/l of P3-Almecolor ®S (a product containing iron(II) salts and organic sulfonic acids) and 20 g/l of sulfuric acid, using alternating current of 16 V at 20° C. for 10 minutes.

After another thorough rinsing with deionized water, sealing according to the invention was carried out. The bloom-preventing agents each were employed in concentrations of 2 g/l, and the sealing was carried out at temperatures of about 96° C. to 98° C.

The specimens for the Comparative Examples were pretreated in an analogous manner and then sealed as described below.

The quality of the surface layer was determined by the so-called dyestuff drop test with preceding acid treatment according to Iso-Standard 2143. In addition, an erosion test according to Iso-Standard 3210 was carried out. The Y-value was determined according to Iso-Standard 3913 by means of an Anotest apparatus Y-D from Fischer. The percentages stated hereafter are percentages by weight.

The most important and crucial criterion for the determination of the decorative effect of the surface quality was the visual evaluation of the sealed surfaces by a panel of experts. The following Table shows, among other data, the surface quality of black dyed specimens rated by the panel of experts in the field of decorative surface technology.

COMPARATIVE EXAMPLE 1

With the use of 2 g/l of an aqueous solution containing 0.7% of the pentasodium salt of cyclohexane-hexacarboxylic acid in the sealing solution, sealing was effected at a pH value within the range of from 5.8 to 6 for times of 60, 40, and 20 minutes. The following Table shows the results obtained.

COMPARATIVE EXAMPLE 2

With the use of 2 gl of an aqueous solution containing 0.7% of the pentasodium salt of the cyclohexanehexacarboxylic acid in the sealing solution, sealing was effected at a pH value within the range of from 7.0 to 7.5 for times of 60, 40 and 20 minutes.

EXAMPLE 1

With the use of 2 g/l of a solution containing 0.8% of 1,1-diphosphonopropane-2,3-dicarboxylic acid (94.2%) and 15% of ammonium acetate in the sealing solution, sealing was effected at a pH value within the range of from 5.8 to 6.2 for times of 60, 40, and 20 minutes. The following Table shows the results obtained.

EXAMPLE 2

With the use of 2 g/l of an aqueous solution containing 0.8% of 1,1-diphosphonopropane-2,3-dicarboxylic acid (94.2%) and 5% of triethanolamine in the sealing solution, sealing was effected as described above. The results obtained are shown in the Table.

EXAMPLE 3

With the use of 2 g/l of an aqueous solution containing 0.7% of 1-phosphonopropane-1,2,3-tricarboxylic acid and 15% of ammonium acetate in the sealing solution, sealing was effected as described above. The following Table shows the results obtained.

EXAMPLE 4

With the use in the sealing solution of 2 g/l of an aqueous solution containing 0.7% of 1-phosphonopropane-1,2,3-tricarboxylic acid and 5% of triethanolamine, sealing was effected as described above. The following Table shows the results obtained.

COMPARATIVE EXAMPLE 3

With the use of 2 g/l of an aqueous solution containing 1.3% of 2-phosphonobutane-1,2,4-tricarboxylic acid (50%) and 15% of ammonium acetate in the sealing solution, sealing was effected as described above. The following Table shows the results obtained.

COMPARATIVE EXAMPLE 4

With the use of 2 g/l of an aqueous solution containing 1,3% of 2-phosphonobutane-1,2,4-tricarboxylic acid (50%) and 5% of triethanolamine in the sealing solution, sealing was effected as described above. The following Table shows the results obtained Examples 5 to 8 according to the invention were performed by repeating Examples 1 to 4 respectively, except that at the beginning of the sealing procedure, sufficient aqueous aluminum sulfate solution to give an aluminum ion concentration of 1 ppm was added to the sealing solutions. In this manner, an iridescent appearance of the sealed surfaces was efficiently prevented.

TABLE

| Example | pH Value | Sealing Time (minutes) | γ-Value | Erosion Test ($mg/dm^2$) | Dyestuff Drop Test % Residual Reflexion | Influence of pH Value | Evaluation by Expert Panel |
|---|---|---|---|---|---|---|---|
| Comp. 1 | 5.8–6.2 | 60 | 18 | 15.3 | 95 | negative | +++ |
| | | 40 | 23 | 17.2 | 93 | | +++ |
| | | 20 | 43 | 21.6 | 85 | | +++ |
| Comp. 2 | 7.0–7.5 | 60 | 17.5 | 15.7 | 94 | negative | +++ |
| | | 40 | 23 | 18.2 | 91 | | +++ |
| | | 20 | 38 | 21.4 | 85 | | ++ |
| 1 | 5.8–6.2 | 60 | 17 | 15.1 | 96 | existing | +++ |
| | | 40 | 20 | 17.5 | 93 | | +++ |

TABLE-continued

| Example | pH Value | Sealing Time (minutes) | γ-Value | Erosion Test (mg/dm²) | Dyestuff Drop Test % Residual Reflexion | Influence of pH Value | Evaluation by Expert Panel |
|---|---|---|---|---|---|---|---|
| | | 20 | 25 | 20.4 | 90 | | +++ |
| 2 | 7.0–7.5 | 60 | 17 | 9.2 | 96 | existing | +++ |
| | | 40 | 18 | 10.1 | 95 | | +++ |
| | | 20 | 25 | 16.2 | 92 | | +++ |
| 3 | 5.8–6.2 | 60 | 20 | 16.2 | 95 | existing | +++ |
| | | 40 | 24 | 19.7 | 91 | | +++ |
| | | 20 | 36 | 22.6 | 88 | | +++ |
| 4 | 7.0–7.5 | 60 | 17 | 14.6 | 94 | existing | +++ |
| | | 40 | 20 | 17.6 | 92 | | +++ |
| | | 20 | 32 | 20.0 | 90 | | ++ |
| Comp. 3 | 5.8–6.2 | 60 | 18 | 21.6 | 93 | existing | ++ |
| | | 40 | 26 | 25.7 | 90 | | ++ |
| | | 20 | 42 | 35.4 | 85 | | ++ |
| Comp. 4 | 7.0–7.5 | 60 | 19 | 23.8 | 93 | | ++ |
| | | 40 | 24 | 25.4 | 90 | | ++ |
| | | 20 | 42 | 30.4 | 85 | | + |

+++ = Very good surface quality
++ = Good surface quality
+ = Marginally acceptable surface quality
0 = Surface quality not acceptable for decorative purposes It is evident from the Table that the sealing formulations according to the invention promoted a markedly good surface quality. It is also noteworthy that improved surface qualities could be achieved with shorter sealing periods when using the process according to the invention. Shorter times for sealing result in large savings in energy, because sealing is performed in virtually boiling aqueous solutions that require a high energy input to maintain at temperature.

What is claimed is:

1. In a process for sealing, at temperatures between 80° C. and the boiling temperature, a decorative anodized oxide layer on aluminum or an aluminum alloy by contacting the oxide layer with an aqueous solution having a pH value between about 5.5 and about 8.5 and containing constituents selected from the group of phosphonic acids and the alkali metal salts and alkanolamine salts of phosphonic acids, the improvement wherein said constituents are selected from the group of 1-phosphonopropane-1,2,3-tricarboxylic acid, 1,1-diphosphonopropane-2,3-dicarboxylic acid, and the alkali metal and alkanolamine salts of 1-phosphonopropane-1,2,3-tricarboxylic acid and 1,1-diphosphonopropane-2,3-dicarboxylic acid.

2. A process according to claim 1, wherein said aqueous solution has a pH value within the range of from about 5.5 to about 6.5.

3. A process according to claim 2, wherein the pH of said aqueous solution is adjusted by the addition of materials selected from the group consisting of acetic acid, ammonia, potassium hydroxide, ammonium acetate, and potassium acetate.

4. A process according to claim 1, wherein said aqueous solution has a pH value within the range of from greater than 6.5 to about 8.5.

5. A process according to claim 1, wherein the pH of said aqueous solution is adjusted by the addition of materials selected from the group consisting of acetic acid, triethanolamine, potassium hydroxide, triethanolammonium acetate, and potassium acetate.

6. A process according to claim 5, wherein said aqueous solution contains a total of from about 0.003 to about 0.1 g/l of stoichiometric equivalents of 1-phosphonopropane-1,2,3-tricarboxylic acid and 1,1-diphosphonopropane-2,3-dicarboxylic acid.

7. A process according to claim 4, wherein said aqueous solution contains a total of from about 0.003 to about 0.1 g/l of stoichiometric equivalents of 1-phosphonopropane-1,2,3-tricarboxylic acid and 1,1-diphosphonopropane-2,3-dicarboxylic acid.

8. A process according to claim 3, wherein said aqueous solution contains a total of from about 0.003 to about 0.1 g/l of stoichiometric equivalents of 1-phosphonopropane-1,2,3-tricarboxylic acid and 1,1-diphosphonopropane-2,3-dicarboxylic acid.

9. A process according to claim 2, wherein said aqueous solution contains a total of from about 0.003 to about 0.1 g/l of stoichiometric equivalents of 1-phosphonopropane-1,2,3-tricarboxylic acid and 1,1-diphosphonopropane-2,3-dicarboxylic acid.

10. A process according to claim 1, wherein said aqueous solution contains a total of from about 0.003 to about 0.1 g/l of stoichiometric equivalents of 1-phosphonopropane-1,2,3-tricarboxylic acid and 1,1-diphosphonopropane-2,3-dicarboxylic acid.

11. A process according to claim 10, wherein said aqueous solution contains from the beginning of the sealing process at least about 1 ppm of aluminum ions.

12. A process according to claim 9, wherein said aqueous solution contains from the beginning of the sealing process at least about 1 ppm of aluminum ions.

13. A process according to claim 8, wherein said aqueous solution contains from the beginning of the sealing process at least about 1 ppm of aluminum ions.

14. A process according to claim 7, wherein said aqueous solution contains from the beginning of the sealing process at least about 1 ppm of aluminum ions.

15. A process according to claim 6, wherein said aqueous solution contains from the beginning of the sealing process at least about 1 ppm of aluminum ions.

16. A process according to claim 5, wherein said aqueous solution contains from the beginning of the sealing process at least about 1 ppm of aluminum ions.

17. A process according to claim 4, wherein said aqueous solution contains from the beginning of the sealing process at least about 1 ppm of aluminum ions.

18. A process according to claim 3, wherein said aqueous solution contains from the beginning of the sealing process at least about 1 ppm of aluminum ions.

19. A process according to claim 2, wherein said aqueous solution contains from the beginning of the sealing process at least about 1 ppm of aluminum ions.

20. A process according to claim 1, wherein said aqueous solution contains from the beginning of the sealing process at least about 1 ppm of aluminum ions.

* * * * *